United States Patent [19]

Adachi et al.

[11] 4,121,489

[45] Oct. 24, 1978

[54] ELECTRONIC MUSICAL INSTRUMENT HAVING PLURAL OSCILLATORS STARTING IN PHASE

[75] Inventors: Takeshi Adachi; Masahiko Koike, both of Hamamatsu, Japan

[73] Assignee: Nippon Gakki Seizo Kabushiki Kaisha, Japan

[21] Appl. No.: 708,300

[22] Filed: Jul. 26, 1976

[30] Foreign Application Priority Data

Jul. 29, 1975 [JP] Japan ..... 50-92287
Jul. 29, 1975 [JP] Japan ..... 50-92288

[51] Int. Cl.[2] ..... G10H 1/04
[52] U.S. Cl. ..... 84/1.24
[58] Field of Search ..... 84/1.01, 1.03, 1.19–1.27, 84/DIG. 7

[56] References Cited

U.S. PATENT DOCUMENTS

| | | | |
|---|---|---|---|
| 3,215,767 | 11/1965 | Martin | 84/1.24 |
| 3,510,565 | 5/1970 | Morez | 84/1.25 |
| 3,790,693 | 2/1974 | Adachi | 84/1.01 |
| 3,809,792 | 5/1974 | Deutsch | 84/1.24 |
| 3,824,326 | 7/1974 | Obatashi | 84/1.25 |
| 3,828,109 | 8/1974 | Morez | 84/1.01 |
| 3,902,396 | 9/1975 | Hiyoshi | 84/1.19 |

*Primary Examiner*—Robert K. Schaefer
*Assistant Examiner*—Vit W. Miska
*Attorney, Agent, or Firm*—Flynn & Frishauf

[57] ABSTRACT

An electronic musical instrument comprises a plurality of tone generators for independently producing tone signals having slightly different frequencies, though fundamentally corresponding to the note of a key depressed on a keyboard; and a mixing circuit coupled to the outputs of the tone generators. The respective tone generators are provided with a control input and are brought to start in the same phase in response to application of an initial synchronizing pulse to the control inputs, thereby attaining clear rise of musical sounds immediately upon key depression. The synchronizing pulse may be produced necessarily at the instant of key depression only when an output of the mixing circuit has a amplitude level lower than a predetermined level.

8 Claims, 6 Drawing Figures

ELECTRONIC MUSICAL INSTRUMENT HAVING PLURAL OSCILLATORS STARTING IN PHASE

BACKGROUND OF THE INVENTION

This invention relates to an electronic musical instrument, and more particularly an electronic musical instrument comprising a plurality of tone generators for independently producing tone signals to be combined in response to the depression of a key.

Some electronic musical instruments comprise a plurality of tone generators for independently producing, upon key depression, tone signals having slightly different frequencies, though fundamentally corresponding to the note of a key depressed on a keyboard and a circuit for mixing outputs from the tone generators, thereby elevating the musical quality of musical sounds produced. With the above-mentioned type of electronic musical instrument, since the frequencies of output signals from the plural tone generators closely resemble each other, output signals from the tone generators may be in an out-of-phase relation at the instant of key depression, and in consequence, an output from the mixing circuit possibly has a considerably small amplitude. This event gives rise to unclear rise of musical sounds upon key depression.

SUMMARY OF THE INVENTION

It is accordingly the object of this invention to provide an electronic musical instrument which is provided with means for preventing output signals from the plurality of tone generators from being in out-of-phase relationship at the instant of key depression.

According to this invention, the respective tone generators have a control pulse-receiving input, and are brought to start in the same phase in response to application of a control pulse to the respective control inputs, and a control pulse generator is provided to produce the control pulse immediately upon key depression.

According to a first embodiment of this invention, the control pulse is produced upon each key depression, i.e., at the moment the key is depressed. According to a second embodiment of the invention, the control pulse is produced upon key depression only when an output signal from a mixing circuit coupled to the outputs of the tone generators has an amplitude level lower than a predetermined level.

This invention is preferably adapted for a synthesizer type electronic musical instrument, though not limited thereto.

DETAILED DESCRIPTION OF THE PREFERRED EMBODIMENTS

Figure 1:
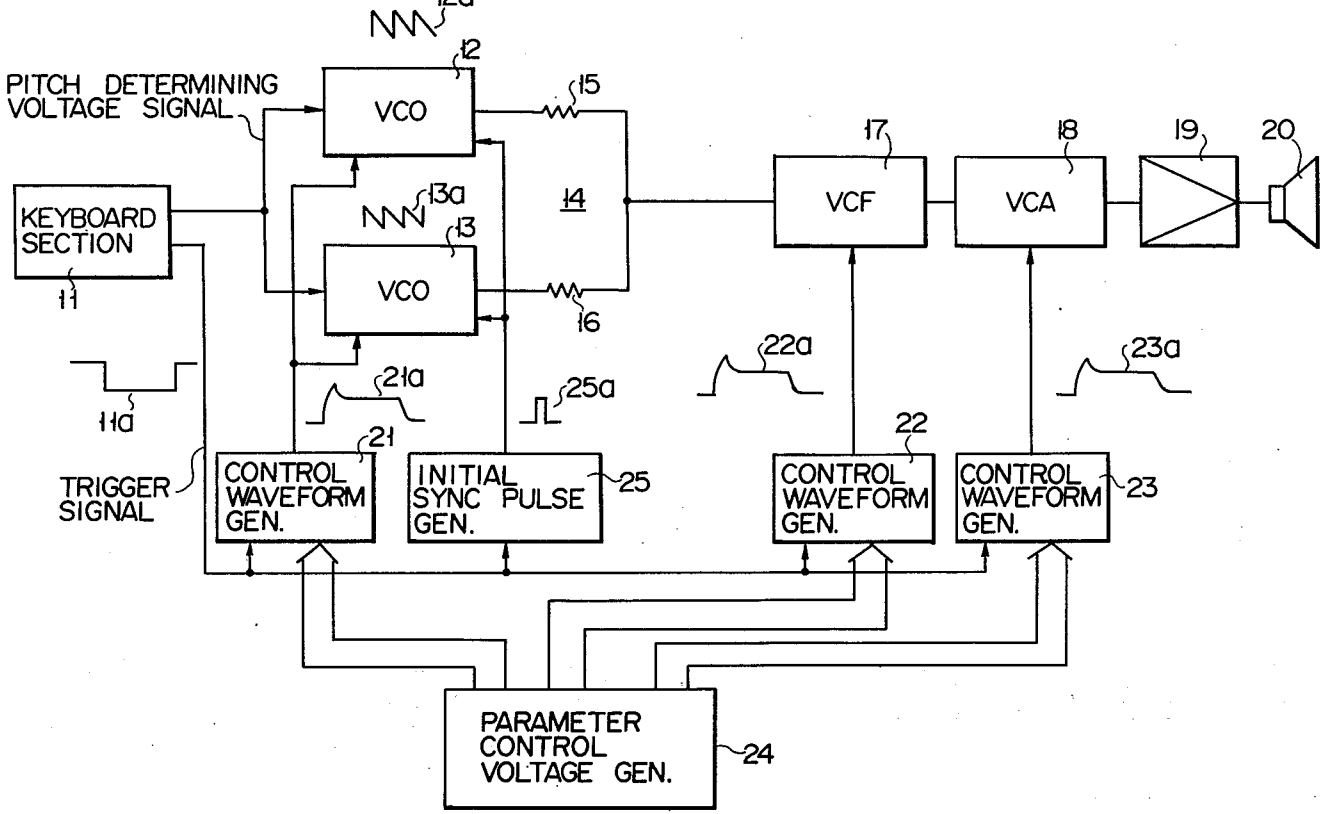
FIG. 1 is a block diagram of an electronic musical instrument according to a first embodiment of this invention.

Referring to FIG. 1 showing an electronic musical instrument according to a first embodiment of this invention, referential numeral 11 shows a keyboard section which comprises a keyboard and circuit means operatively coupled to the keyboard for producing, upon key depression, a pitch determining voltage signal having a magnitude corresponding to the note of a key depressed and a key depression-representing negative-going signal or trigger signal 11a which is sustained from key depression to key release. The pitch-determining voltage signal from the keyboard section 11 is conducted to first and second voltage-controlled variable frequency oscillators 12, 13 (hereinafter abbreviated as "VCO"). When supplied with a pitch-determining votlage signal, the VCO's independently produce tone signals 12*a*, 13*a* having frequencies slightly differentiated, for example, only by several hertz, though fundamentally corresponding to the note of a key depressed on the keyboard and having a complex waveform, for example, like that of a saw tooth. Output signals 12*a* and 13*a* from the VCO's 12, 13 are mixed together by a mixing circuit 14 having mixing resistors 15 and 16. Later, the output signals 12*a*, 13*a* are successively delivered to a voltage-controlled filter (hereinafter abbreviated as "VCF") 17 for modifying an audio spectrum, voltage-controlled amplifier (abbreviated as "VCA") 18 for imparting an envelope to the filtered tone signals, amplifier 19, and loudspeaker 20 for sounding the note of a key depressed on the keyboard. The VCA is normally in a cutoff state and is rendered conducting when supplied with the later described control waveform.

The VCO's 12, 13, VCF 17 and VCA 18 are supplied with control waveforms 21*a*, 22*a*, 23*a* changing with time in voltage from the corresponding control waveform generators 21, 22, 23. The control waveform generators 21, 22, 23 are triggered by the trigger signal 11*a* delivered from the keyboard section 11 to commence production of control wavefroms, and also are supplied with a plurality of parameter-controlling voltage signals for determining the shape of control waveforms produced by a parameter-controlling voltage generator 24.

With the electronic musical instrument having the construction so far described, output tone signals from the VCO's 12, 13 produced upon key depression have an indefinite phase, so that the output tone signals may be kept out of phase, possibly causing an output from the mixing circuit to be decreased in amplitude level, and giving rise to unclear rise of musical sounds.

According to this invention, there is connected between the VCO's 12, 13 and the keyboard section 11 an initial synchronizing pulse generator 25 for producing an initial synchronizing or control pulse at the instant of key depression in response to the trigger signal 11*a*. The VCO's 12, 13 have an input for receiving the initial synchronizing pulse 25*a*, and, responsive to application of the initial synchronizing pulse 25*a* to the synchronizing pulse receiving input, commence production of tone signals starting from the same phase position, thereby preventing the amplitude level of an output signal from the mixing circuit 14 from being decreased upon key depression.

Figure 2:
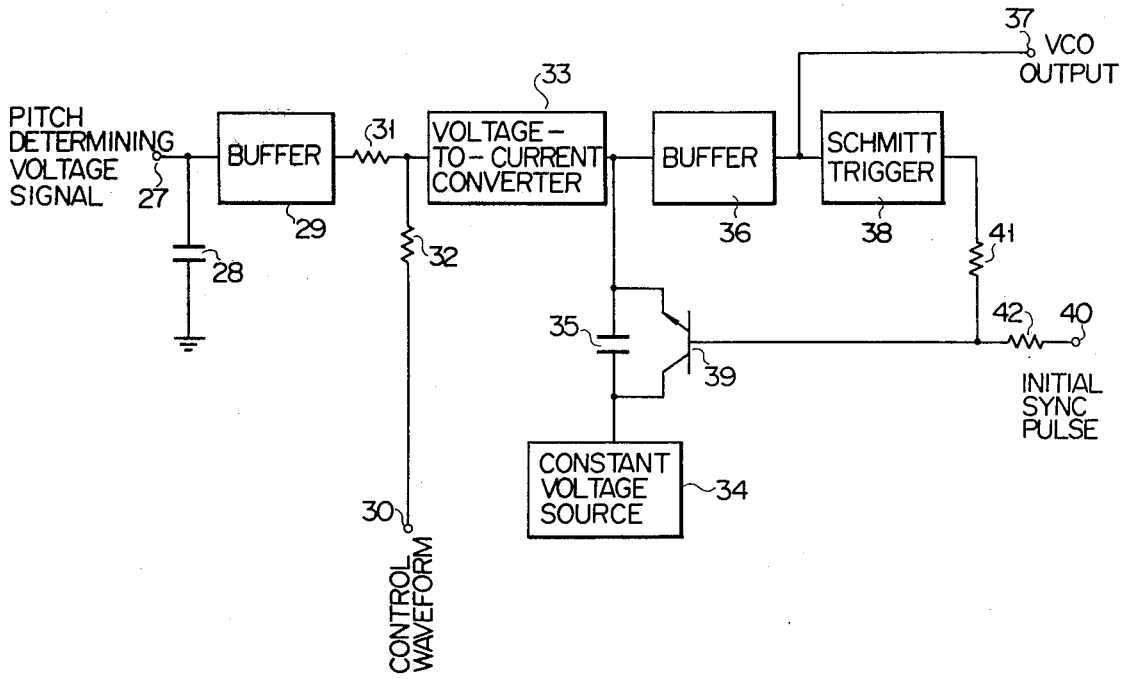
FIG. 2 is a block diagram of each voltage-controlled osicllator of FIG. 1.

FIG. 2 shows a practical block diagram of the VCO's of FIG. 1. Referential numeral 27 is an input for receiving a pitch-determining voltage signal from the keyboard section 11. The magnitude of the pitch-determining voltage signal is stored in a capacitor 28. A signal stored in the capacitor 28 is read out through a buffer stage 29 having a high input resistance to be mixed by resistors 31, 32 with a control waveform applied from the control waveform generator 21 to an input 30 of the VCO. The sum of a pitch-determining voltage signal and control waveform is applied as an input voltage to a voltage-to-current converter 33 to produce output current proportional to the input voltage. A capacitor 35 is connected between the converter 33 and a constant voltage source 34. The capacitor 35 is charged by output current from the converter 33. The voltage of the capacitor 35 is read out by a buffer stage 36 having a high input resistance to be delivered to the output 37 of the VCO and a Schmitt trigger 38. When the voltage of the capacitor 35 reaches a predetermined level, the Schmitt trigger circuit 38 produces an output, which in turn is transmitted to the base of a transistor 39 connected in parallel to the capacitor 35. Upon receipt of an output from the Schmitt trigger circuit 38, the transistor 39 conducts to discharge the capacitor 35. Repeated charging and discharging of the capacitor 35 develop tone signals at the output 37 of the VCO. An initial synchronizing pulse 25*a* from the initial synchronizing pulse generator 25 is conducted through an input 40 to the base of the transistor 39 to put it into conduction with the resultant discharge of the capacitor 35. Namely, the action of the initial synchronizing pulse 25*a* to the VCO's 12, 13 is to charge the capacitor 35 of the VCO's 12, 13 respectively just after the existence of the pulse 25*a* from the same potential, namely, cause the VOC's 12, 13 to produce tone signals starting from the same phase position. Referential numerals 41, 42 denote mixing resistors.

Figure 3:
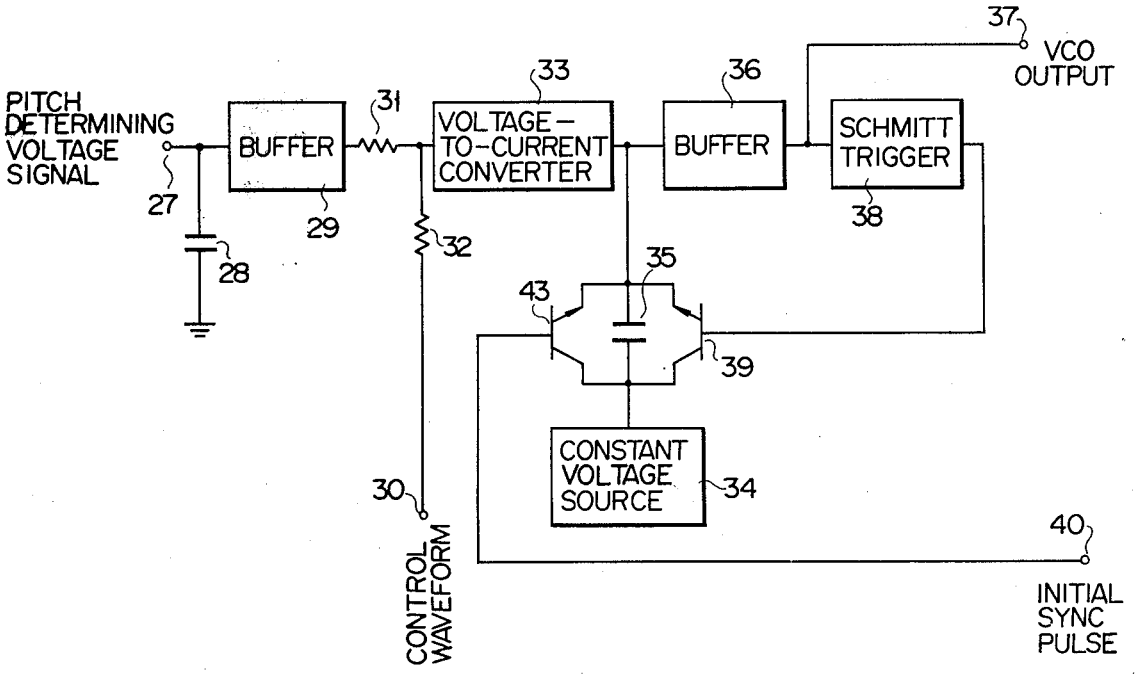
FIG. 3 is a modification of the voltage-controlled oscillator of FIG. 2.

FIG. 3 is a modification of the VCO of FIG. 2. An additional transistor 43 whose base is supplied with the initial synchronizing pulse is connected in parallel to the transistor 39 whose base is coupled to the output of the Schmitt trigger circuit 38 and capacitor 35. The parts of FIG. 3 the same as those of FIG. 2 are denoted by the same numerals, description thereof being omitted.

Figure 4:
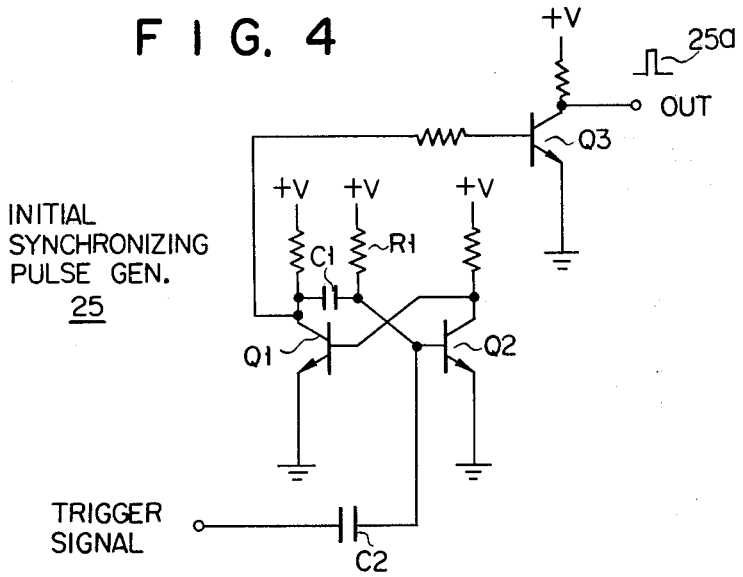
FIG. 4 shows a schematic circuit arrangement of an initial synchronizing pulse generator of FIG. 1.

FIG. 4 schematically shows a practical circuit arrangement of the initial synchronizing pulse generator 25. This pulse generator 25 comprises a one-shot multivibrator including a normally nonconductive transistor Q1, normally conductive transistor Q2, resistor R1 and capacitor C1. The negative going trigger signal 11*a* is applied through a capacitor C2 to the base of the normally conductive transistor Q2, which is rendered nonconductive in response to the negative transition of the trigger signal 11*a* upon key depression. On the other hand, the normally nonconductive transistor Q1 is rendered conductive in response to the transistor Q2 being rendered nonconductive. A normally conductive transistor Q3 whose base is coupled to the collector of the transistor Q1 is rendered nonconductive in response to the transistor Q1 being rendered conductive. Accordingly, a positive-going initial synchronizing pulse 25*a* whose duration is defined by a time constant of the resistor R1 and capacitor C1 is produced at the collector of transistor Q3.

Figure 5:
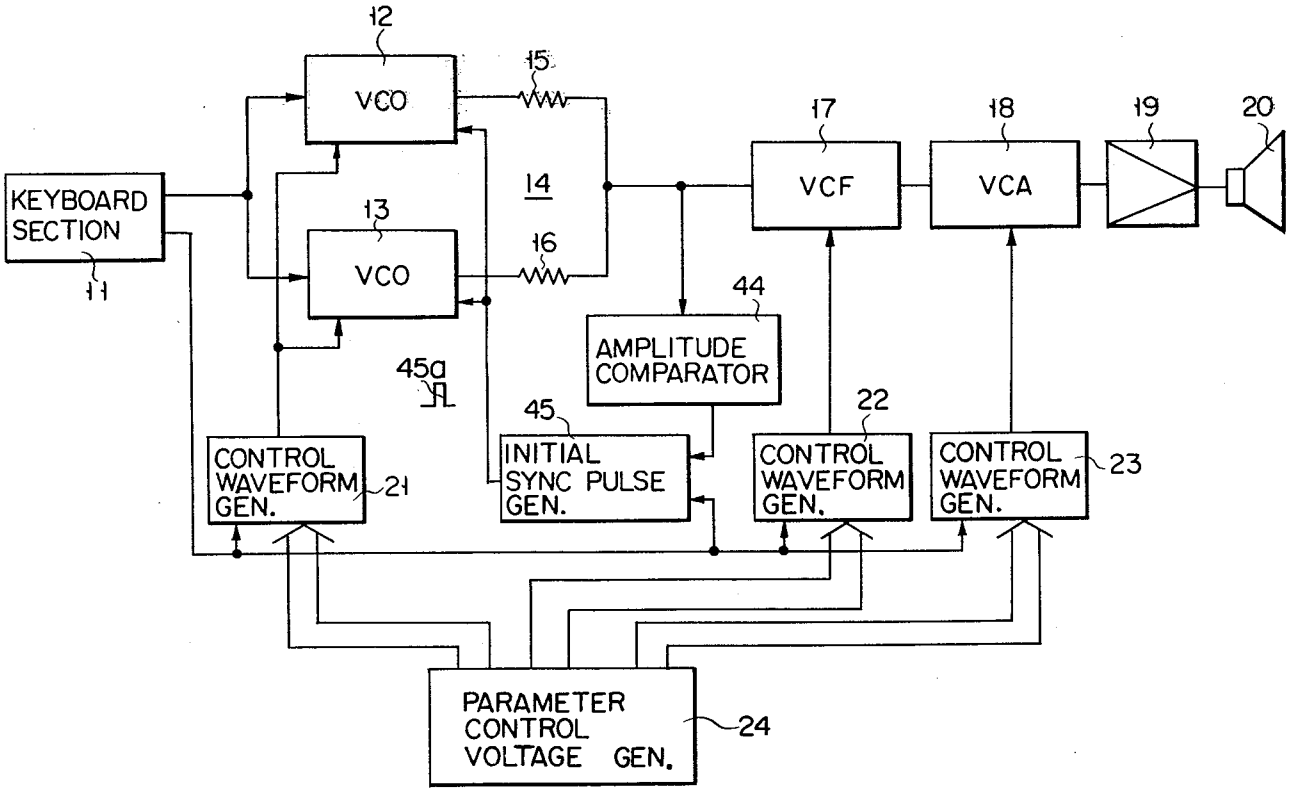
FIG. 5 is a block diagram of an electronic musical instrument according to a second embodiment of the invention.

With the first embodiment of FIG. 1, the VCO's 12, 13 are made, upon key depression, ready for production of tone signals from the same phase position. In contrast, the second embodiment of FIG. 5 is so constructed that the VCO's 12, 13 are initially synchronized only when a sum of output signals from the VCO's 12, 13 falls below a predetermined amplitude level upon key depression. The parts of FIG. 5 the same as those of FIG. 1 are denoted by the same numerals, description thereof being omitted.

With the second embodiment of FIG. 5, to the output of the mixing circuit 14 is connected an amplitude comparator 44 which compares the amplitude level of an output signal from the mixing circuit 14 with a referantial amplitude level, and to the outputs of the comparator 44 and keyboard section 11 is connected an initial synchronizing pulse generator 45 which produces an initial synchronizing pulse 45*a* upon key depression when the amplitude comparator 44 produces an output showing that an output signal from the mixing circuit 14 has a lower amplitude level than predetermined and applies the initial synchronizing pulse 26 to the VCO's 12, 13.

Figure 6:
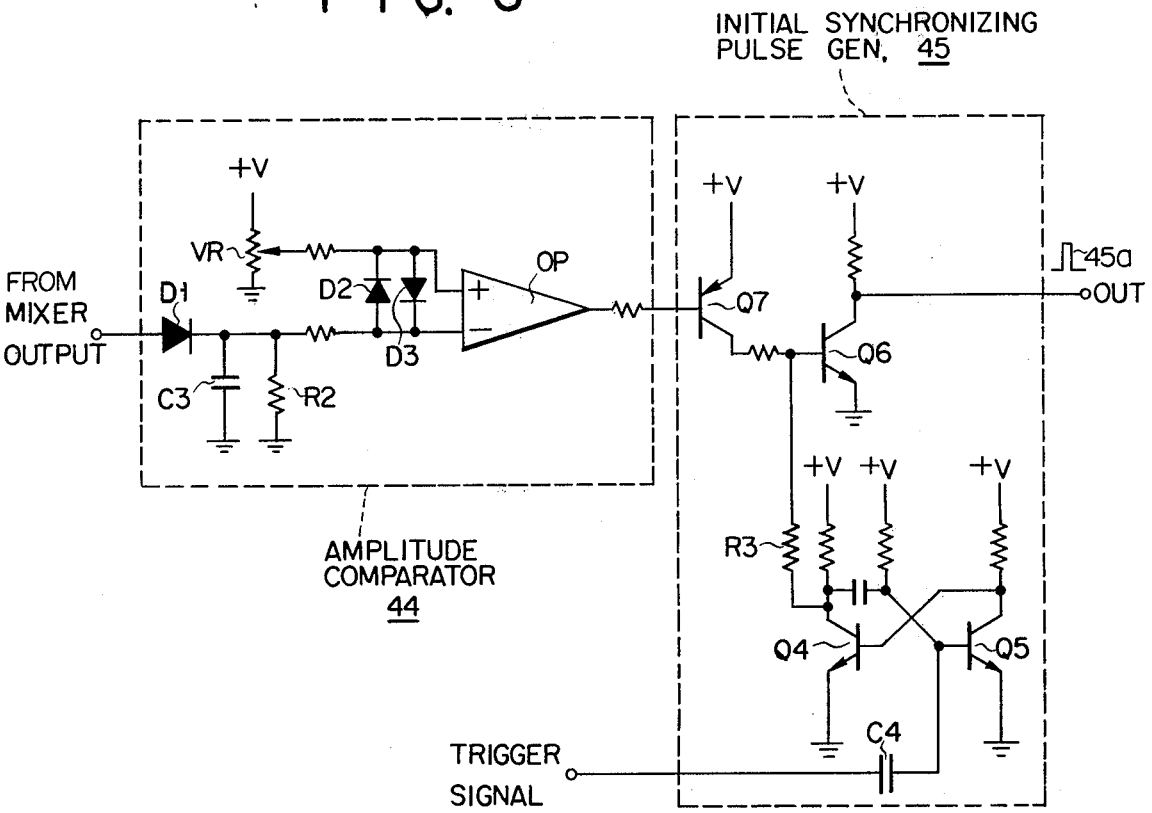
FIG. 6 indicates a schematic circuit arrangement of an amplitude comparator and initial synchronizing pulse genrerator of FIG. 5.

There will now be described by reference to FIG. 6 the practical circuit arrangements of the amplitude comparator 44 and initial synchronizing pulse generator 45.

An output signal from the mixing circuit 14 is applied to a rectification circuit including a diode D1, capacitor C3 and resistor R2 to be converted into a D.C. voltage and later supplied to an inverting input of a comparison amplifier or voltage comparator OP. A noninverting input of the comparison amplifier OP is connected to receive a referential voltage defined by a variable resistor VR coupled across a supply voltage. Diodes D2, D3 connected between both inputs of the comparison amplifier OP are formed of silicon to prevent differential input voltage to the comparison amplifier OP from rising to a high level. The output of the comparison amplifier OP is coupled to the base of a transistor Q7. The comparator OP produces an output which renders the transistor Q7 conductive when the output voltage level of rectifier circuit is greater than the reference voltage level determined by the variable resistor VR and produces, on the other hand, an output which renders the transistor Q7 nonconductive when the output voltage level of rectifier circuit is smaller than the reference voltage level.

A trigger signal from the keyboard section 11 is coupled through a capacitor C4 to the base of a normally conductive transistor Q5 constituting a one-shot multivibrator with a normally nonconductive transistor Q4 to thereby render, upon key depression, the normally nonconductive transistor Q4 conductive and the normally conductive transistor Q5 nonconductive. The collector of transisor Q4 is connected to the base of a transistor Q6 through a resistor R3 and the collector of transistor Q7. When the transistor Q4 is nonconductive the transistor Q6 is conductive, and when the transistor Q4 is conductive, the state of the transistor Q6 depends on the state of transistor Q7. That is, the transistor Q6 is conductive when the transistor Q7 is conductive and the transistor Q6 is nonconductive when the transistor Q7 is nonconductive. Accordingly, when, upon key depression, the one-shot multivibrator including transistors Q4 and Q5 produces an output, and an output signal from the mixing circuit 14 has a lower amplitude level than predetermined, namely when the transistor Q7 becomes nonconductive, then the transistor Q6 produces a positive-going initial synchronizing pulse 45*a*.

What we claim is:

1. An electronic musical instrument comprising:

a keyboard having keys;

a plurality of tone generators each having an output and a control input, and producing, upon key depression on said keyboard, tone signals corresponding to the note of a key depressed which have at said outputs slightly different frequencies from each other; and means operatively coupled to said keyboard for producing and applying a control pulse, at the moment a key is depressed, to said control inputs of said tone generators to compel said tone signals to always start from substantially the same phase position.

2. An electronic musical instrument comprising:

a keyboard having keys;

a plurality of tone generators each having an output and a control input, and producing, upon key depression on said keyboard, tone signals corresponding to the note of a key depressed which have at said outputs slightly different frequencies from each other;

means operatively coupled to said keyboard for producing and applying a control pulse, at the moment a key is depressed, to said control inputs of said tone generators to compel said tone signals to always start from substantially the same phase position; and means coupled to said outputs of said tone generators to mix the tone signals from said tone generators.

3. An electronic musical instrument comprising:

a keyboard section including a keyboard having keys and means for producing a signal denoting key depression on said keyboard;

a plurality of tone generators coupled to said keyboard section, each tone generator having an output and a control input, said tone generators producing, upon key depression on said keyboard, tone signals corresponding to the note of a key depressed which have at said outputs slightly different frequencies from each other;

means coupled between said keyboard section and said control inputs of said tone generators for producing, at the moment a key is depressed, a control pulse in response to the signal denoting key depression on said keyboard section and applying the control pulse to said control inputs of said tone generators to compel said tone signals to always start from substantially the same phase position; and means coupled to said outputs of said tone generators to mix tone signals from said tone generators.

4. An electronic musical instrument comprising:

a keyboard section including a keyboard having keys and means for producing a signal representing key depression on said keyboard;

a plurality of tone generators coupled to said keyboard section, each tone generator having an output and a control input, said tone generators producing, upon key depression on said keyboard, tone signals corresponding to the note of a key depressed which have at said outputs slightly different frequencies from each other;

mixing means coupled to said outputs of said tone generators for mixing tone signals from said tone generators; and means coupled to said means of said keyboard section for producing the signal denoting key depression on said keyboard and to the output of said mixing means for producing, at the moment a key is depressed, a control pulse in response to the signal representing key depression, when an output voltage from said mixing means has a level lower than a predetermined level and applying the control pulse to said control inputs of said tone generators to compel said tone signals to always start from substantially the same phase position.

5. An electronic musical instrument comprising:

a keyboard section including a keyboard having keys and means operatively coupled to said keyboard for producing, upon key depression, a pitch-determining voltage signal having a magnitude corresponding to the note of a key depressed and a signal denoting the key depression;

a plurality of voltage-controlled variable frequency oscillators coupled to said keyboard section, each oscillator having a pitch-determining voltage signal receiving input for receiving the pitch-determining voltage signal, an output and a control input, said oscillators producing, in response to application of a pitch-determining voltage signal from said keyboard section to said pitch-determining voltage signal receiving input, tone signals at said outputs having slightly different frequencies from each other which are determined by said pitch determining voltage signal and corresponding to the note of a key depressed;

means connected between said keyboard section and said control inputs of said oscillators for producing a control pulse, at the moment a key is depressed, in response to the signal representing key depression on said keyboard to compel said tone signals to always start from substantially the same phase position; and mixing means coupled to said outputs of said oscillators to mix tone signals therefrom.

6. An electronic musical instrument according to claim 5, wherein said voltage-controlled variable frequency oscillators each have a control waveform receiving input for receiving a control waveform to vary the output frequency thereof according to the shape of the control waveform; and wherein means for producing the control waveform upon receipt of the key depression-representing signal from said keyboard section is coupled between said control waveform-receiving inputs of said oscillators and said keyboard section.

7. An electronic musical instrument comprising:

a keyboard section including a keyboard having keys and means operatively coupled to said keyboard for generating, upon key depression on said keyboard, a pitch-determining voltage signal having a magnitude corresponding to the note of a key depressed and a key depression-representing signal;

a plurality of voltage-controlled variable frequency oscillators coupled to said keyboard section, each oscillator having a pitch-determining voltage signal receiving input for receiving the pitch-determining voltage signal from said keyboard section, an output and a control input, said oscillators producing, in response to application of the pitch-determining voltage signal from said keyboard section to said pitch-determining voltage receiving inputs, tone signals at said outputs having slightly different frequencies from each other which are determined by said pitch-determining voltage signal and corresponding to the note of a key depressed;

mixing means coupled to said outputs of said oscillators for mixing output signals therefrom; and means coupled to said keyboard section to receive the key depression-representing signal therefrom and to said mixing means to receive an output signal therefrom for producing, at the moment a key is depressed, a control pulse in response to the key depression-representing signal, when the output signal from said mixing means has an amplitude level lower than a predetermined level and applying the control pulse to said control inputs of said voltage-controlled variable frequency oscillators to compel said tone signals to always start from substantially the same phase position.

8. An electronic musical instrument according to claim 7, wherein said voltage-controlled variable frequency oscillators each have a control waveform receiving input for receiving a control waveform to vary the output frequency thereof according to the shape of control waveform; and wherein means for producing the control waveform upon receipt of the key depression-representing signal from said keyboard section is coupled between said control waveform-receiving inputs of said voltage-controlled variable frequency oscillators and said keyboard section.

* * * * *